United States Patent [19]

Mori

[11] 4,019,484

[45] Apr. 26, 1977

[54] IGNITION APPARATUS FOR INTERNAL COMBUSTION ENGINE

[75] Inventor: Yasunori Mori, Hitachi, Japan

[73] Assignee: Hitachi, Ltd., Japan

[22] Filed: Feb. 10, 1975

[21] Appl. No.: 548,800

[30] Foreign Application Priority Data

Feb. 12, 1974 Japan ..... 49-16209
Apr. 30, 1974 Japan ..... 49-47671

[52] U.S. Cl. ..... 123/148 E; 315/209 T

[51] Int. Cl.[2] ..... F02P 1/00

[58] Field of Search ..... 123/148 E; 315/209 T

[56] References Cited

UNITED STATES PATENTS

| | | | |
|---|---|---|---|
| 3,575,154 | 4/1971 | Taylor | 123/148 E |
| 3,660,689 | 5/1972 | Oishi | 123/148 E |
| 3,831,571 | 8/1974 | Weber | 123/148 E |
| 3,841,288 | 10/1974 | Korteling | 123/148 E |
| 3,867,916 | 2/1975 | Bigalke | 123/148 E |
| 3,874,355 | 4/1975 | Suda | 123/148 E |
| 3,875,912 | 4/1975 | Bullo | 123/148 E |
| 3,881,458 | 5/1975 | Roozenbeek et al. | 123/148 E |
| 3,882,840 | 5/1975 | Adamian et al. | 123/148 E |
| 3,889,651 | 6/1975 | Hudson | 123/148 E |
| 3,943,896 | 3/1976 | Green | 123/148 E |

*Primary Examiner*—Ronald B. Cox
*Attorney, Agent, or Firm*—Craig & Antonelli

[57] ABSTRACT

An ignition apparatus for an internal combustion engine, wherein the energization time of the primary winding of the ignition coils is maintained constant regardless of the engine revolutions, is provided with reference time signal generator means within the apparatus. The reference time signal thus produced from the reference time signal generator means is compared with an actual energization time, and the time difference therebetween is negatively fed back to the energization time signal generator means, thereby controlling the energization time in such a way as to always approximate the reference time.

4 Claims, 6 Drawing Figures

IGNITION APPARATUS FOR INTERNAL COMBUSTION ENGINE

BACKGROUND OF THE INVENTION

1. Field of the Invention

This invention relates to an ignition apparatus for an internal combustion engine, or more in particular to an ignition apparatus having a control circuit for maintaining constant the time period during which the primary current flows in the ignition coils.

2. Description of the Prior Art

Generally, a current of predetermined magnitude must be supplied to the primary winding of the ignition coils in order to apply an appropriate ignition voltage to the ignition plug of an internal combustion engine. In the event that the primary current is larger than the amount required for supplying an appropriate ignition voltage or that the current flows in the primary winding for an unnecessarily long time, a considerable amount of the current supplied from the power source of the ignition voltage is wasted. Thus, it is necessary to control at a fixed level the time during which the primary current flows. In a conventional ignition apparatus of this type, the increase in current in the power transistor at the last stage for conducting and cutting off the primary current is obstructed with an the same time controlled by negative feed back to some degree during the time which the current flows in the primary winding. Strictly speaking, however, such an apparatus does not effect any control whereby the primary current flow time is fixedly maintained, and poses a necessity for controlling the current to prevent increase thereof as well as the resulting problem of heat generated in the power transistor at the last stage. If the current flow time is constantly strictly controlled, the need for other control devices is totally eliminated, thus making it possible to obtain an ideal ignition apparatus which generates very little heat.

SUMMARY OF THE INVENTION

An object of the present invention is to obviate the above-mentioned disadvantages of the conventional ignition apparatuses and to provide an ignition apparatus for the internal combustion engine in which the flow time of the primary current in the ignition coils for igniting the engine is capable of being controlled at a constant level regardless of the engine revolutions.

Further object of the invention is to provide an improved ignition apparatus for an internal combustion engine in which delay time between an ignition signal from a pick up coil and an actual ignition spark becomes shorter.

According to the invention, there is provided an ignition apparatus comprising means for generating a signal representing the time during which the current flows in the ignition coils, means for generating a reference time signal corresponding to an optimum flow time of the primary current, and means for detecting the difference between the energization time signal and the reference time signal and for negatively feeding back the difference therebetween to the energization time signal generator means.

Further characteristic of the invention is that an ignition signal from a pick up coil is received by an element with high input impedance such as operation amplifier.

In general, a pick up coil has a large reactance, because number of winding is increased to increase an ignition signal voltage of the pick up coil especially in low speed condition of the engine. Therefore the current flowing in the pick up coil is lagged in timing to the voltage thereof due to the pick up coil's reactance, and so the actual spark timing is also lagged from desired timing. Such delay can be reduced by increasing the input impedance of the element such as comparator which receives the ignition signal from the pick up coil.

DESCRIPTION OF THE PREFERRED EMBODIMENTS

Figure 1:
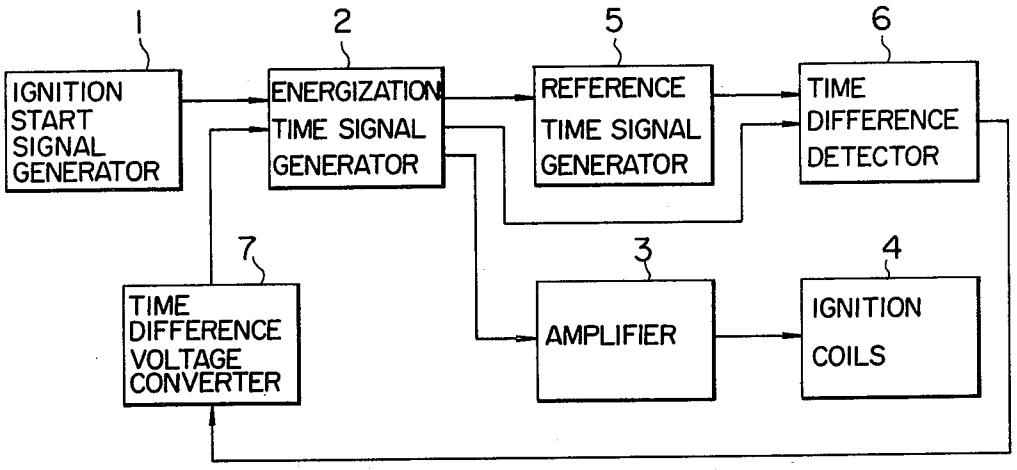
FIG. 1 is a block diagram showing an embodiment of the present invention.

Referring first to FIG. 1 showing a block diagram of an embodiment of the invention, reference numeral 1 shows means driven in synchronism with the engine for generating an ignition starting signal, numeral 2 an energization time signal generator circuit for generating an energization time signal in synchronism with the output signal of the starting signal generator means 1, and numeral 3 amplifier means through which the output signal from the energization time signal generator means 2 is transmitted to the ignition coils 4.

Reference numeral 5 shows reference time signal generator means for generating a reference time signal in synchronism with the output signal from the energization time signal generator means. Numeral 6 shows time difference detector means for comparing the output of the energization time generator means with the output of the reference time signal generator means and thereby detecting the difference therebetween. The voltage corresponding to the time detected by the time difference detector means 6 is generated by the time difference voltage converter means 7, the output of which is negatively fed back to the energization time generator means 2.

The energization time of the ignition coils 4 is kept substantially constant regardless of the engine revolutions since it is always controlled in such a manner as to approximate the time output of the reference time signal generator means 5.

Figure 2:
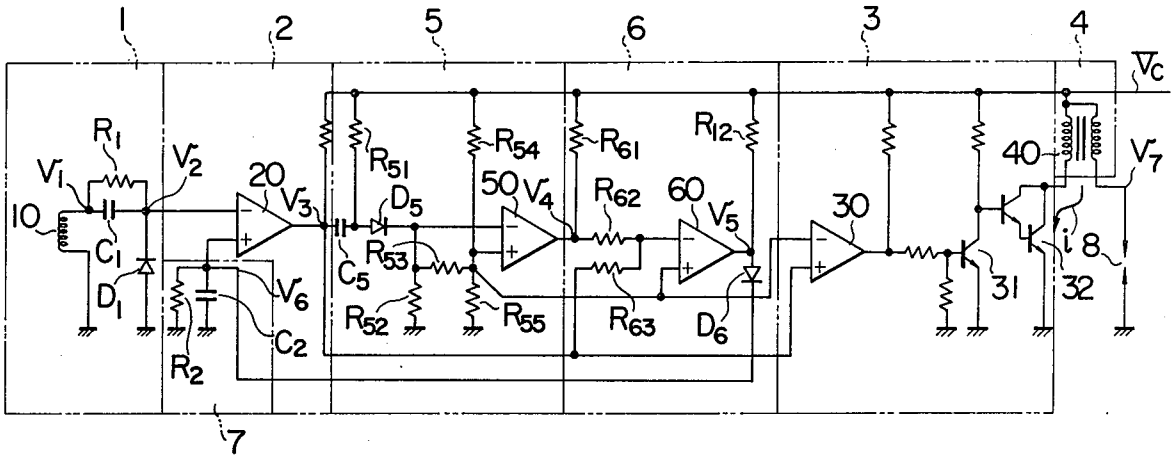
FIG. 2 is a diagram showing an actual circuit configuration of an embodiment of the invention.

A detailed circuit configuration of the embodiment of the invention is shown in FIG. 2. In the figure, reference numeral 10 shows a pick-up coil for generating an AC signal, the output of which is applied to the input terminal of the comparator 20 through the resistor $R_1$ and the capacitor $C_1$. Symbol $D_1$ shows a diode. A parallel circuit comprising the resistor $R_2$ and capacitor $C_2$ makes up the time difference signal voltage converter 7 for generating the reference voltage for the comparator 20. The reference time signal generator means 5 includes a comparator 50 and a time constant circuit having a resistor $R_{51}$ and capacitor $C_5$. The comparator 50 is provided for comparing the cathode voltage of the diode $D_5$ with the voltage at the dividing point between the resistors $R_{54}$ and $R_{55}$, the symbols $R_{52}$ and $R_{53}$ denoting resistors. A NOR circuit comprising the resistors $R_{61}$, $R_{62}$ and $R_{63}$ and the comparator 60 makes up the time difference detector means 6, the output of which is applied through the diode $D_6$ to the time difference voltage converter means 7.

The output terminal of the comparator 20 is connected to the resistor $R_{63}$ of the NOR circuit and to the comparator 30 of the amplifier circuit 3. The output terminal of the comparator 30 is connected to the base of the amplifying transistor 31, the collector of which is in turn connected to the base of the Darlington pair 32 connected in series with the primary winding 40 of the ignition coils 4, numeral 8 showing a spark plug.

The operation of the circuit under consideration will be explained below.

Figure 3:
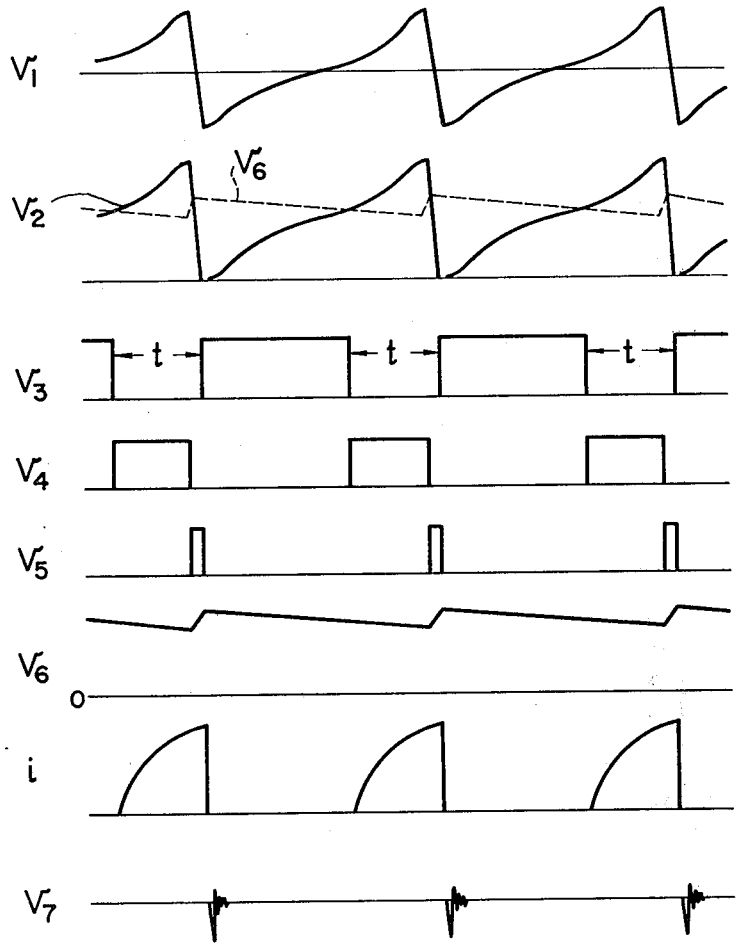
FIG. 3 is a diagram for explaining the operation of the circuit shown in FIG. 2.

Referring to the diagram of FIG. 3 showing the output waveform curve V1 of the pick-up coil 10, the ignition time point is selected at a point on the curve with a sharp negative gradient. By determining the time constant due to the resistor $R_1$ and capacitor $C_1$ at a value larger than the repetition frequency of the ignition, the capacitor $C_1$ is charged through the diode $D_1$ during the negative half cycle of the pick-up output voltage and held in accordance with the time constant due to the resistor $R_1$ and capacitor $C_1$, with the result that the input waveform V2 changes parallelly into the waveform V2 as shown in FIG. 3 which rises from zero. The reference voltage V6 for the comparator 20, which is the result of feed back from a subsequent stage, is compared with the input voltage V2 in the comparator 20. In the event that V2 is higher than V6, the output V3 of the comparator 20 is zero, whereas V3 is equal to the source voltage VC when V2 is lower than V6. In other words, the waveform as shown by V3 in FIG. 3 is obtained. The present invention intends that the reference voltage V6 of the comparator 20 is automatically produced in such a manner that the time period *t* during which the voltage V3 is zero, namely, the time during which current *i* is flowing in the ignition coils is constant. Under this condition, the cathode voltage of the diode $D_5$ is generally rendered higher and therefore the output V4 of the comparator 50 is zero. If the output voltage V3 of the comparator 20 drops from a positive value to zero, the time constant circuit comprising the resistor $R_{51}$ and capacitor $C_5$ causes the output of the comparator 50 to rise from zero to a positive value in such a manner as shown in curve V4 of FIG. 3. A fixed time period thus generated is used as the reference time V4 described already. When the waveform V4 of the reference time and the output V3 of the comparator 20 are applied to the NOR circuit of the time difference detector means 6, the output V5 becomes positive only during the time period corresponding to the difference between the reference time and the time during which the output V3 of the comparator 20 is zero, as shown by V5 in FIG. 3.

When the output voltage V5 of the comparator 60 is positive, the capacitor $C_2$ is charged through the resistor $R_{12}$ and diode $D_6$, the amount of charges being proportional to the time period during which the output voltage V5 is positive. The capacitor $C_2$ is discharged at a predetermined time constant by means of the resistor $R_2$ connected in parallel therewith, so that the voltage V6 increases with the increase in the deviation from the reference time. As a result, the output voltage V3 of the comparator 20 is held at zero for a shorter period of time, thereby minimizing the deviation by negative feedback control. The signal V3 thus controlled is applied to the comparator 30 for amplification, and further amplified in the transistor 31. The output of the transistor 31 is applied to the base of the switching power transistor 32, so that the switching power transistor 32 is operated in accordance with the signal V3, thus supplying current *i* to the primary winding 40 of the ignition coils 4. A high voltage V7 is generated in the secondary side of the ignition coils 4 at the time of cutting off of the transistor 32, thereby producing a spark in the spark plug 8.

According to the circuit configuration described above, the flow time of the current supplied to the ignition coils is maintained constant irrespective of the engine revolutions and therefore the waste of current flow in the ignition coils is prevented, thereby minimizing the heat generated by the apparatus as a whole. In view of the fact that no excess current flows in the switching power transistor, the requirement for measures to be taken against generated heat are also minimized, thus making it possible to use a low-cost transistor. Further, the current-limiting resistor which otherwise might be required in series with the ignition coils may be done without. Furthermore, the fact that the consumption of current is proportional to the engine revolutions makes possible an increased efficiency at low speed as compared with the conventional apparatus having no control means.

In spite of the foregoing description of an embodiment wherein the source voltage is assumed to be constant, the source voltage is subjected to variations in the case of the internal combustion engine. Let the inductance of the ignition coils be L, the resistance value thereof R and the source voltage Vc. Then the primary current Ic of the ignition coils is expressed by equation (1) below.

$$I_c = \frac{V_c}{R}\left(1 - \epsilon - \frac{R}{L}t\right) \tag{1}$$

Figure 4:
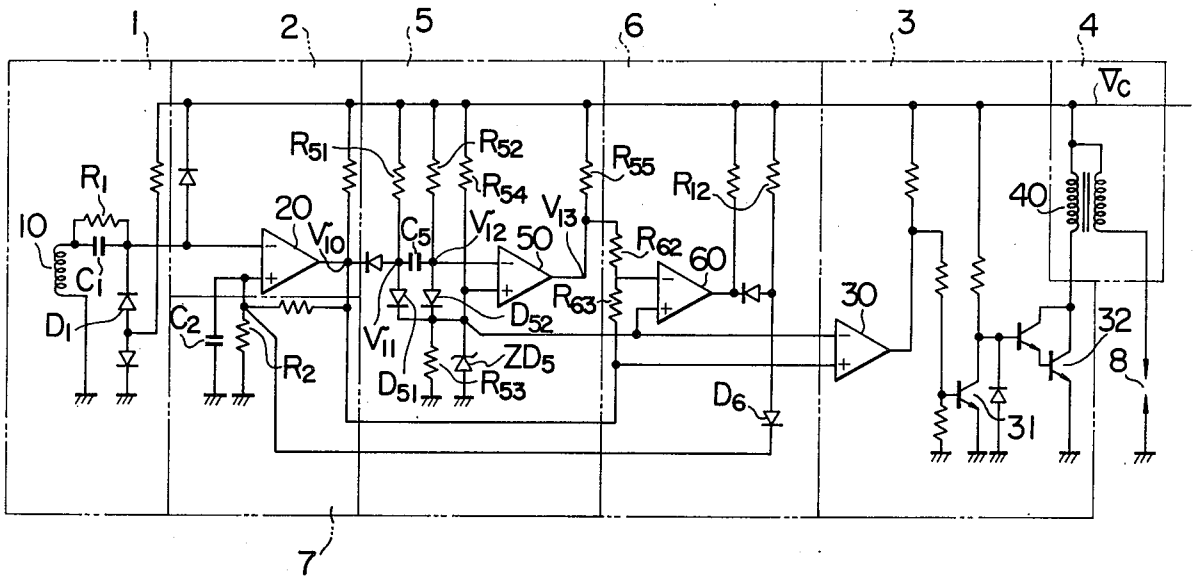
FIG. 4 is a circuit diagram showing another embodiment of the invention.
Figure 5:
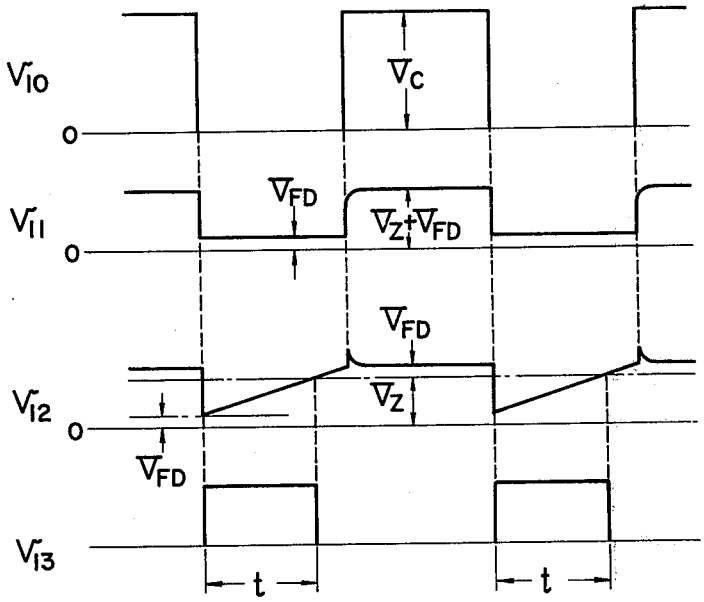
FIG. 5 is a diagram for explaining the operation of the circuit shown in FIG. 4.

It is therefore necessary to control the reference time taking into consideration the variations in source voltage. An embodiment of the invention having such control characteristics is shown in FIG. 4. The feature of the embodiment under consideration resides in that the reference time generator means 5 comprising the comparator 50, the resistors $R_{51}$ to $R_{55}$, diodes $D_5$ and $D_6$ and zener diode $ZD_5$ produces an output signal varying with the source voltage $V_c$. The diagram of FIG. 5 shows voltage waveforms of voltages $V_{10}$ to $V_{13}$ to produced at various points in the above-mentioned circuit.

In the reference time generator means 5 of FIG. 4, when the voltage $V_{10}$ changes from $V_c$ to zero, the voltage $V_{11}$ changes from $V_Z + V_{FD}$ to $V_{FD}$, where $V_Z$ is the voltage across the zener diode $ZD_5$, and $V_{FD}$ the forward voltage drop in the diode $D_5$.

Then, the voltage $V_{12}$, after decreasing in step from $V_Z + V_{FD}$ down to $V_{FD}$, increases at a gradient determined by the time constant due to the resistor $R_{52}$ and the capacitor $C_5$. When this voltage exceeds the zener voltage $V_Z$, the comparator 50 is reversed and produces a voltage with the time width of *t* as the voltage $V_{13}$. The relation between the above-mentioned voltages is $$V_Z = (V_c - V_{FD})\left(1 - \epsilon - \frac{t}{C_5 \cdot R_{52}}\right) \quad (2)$$

Since $V_c >> V_{FD}$, the equation (2) may alternatively be expressed as:

$$V_Z = V_c\left(1 - \epsilon - \frac{t}{C_5 \cdot R_{52}}\right) \quad (3)$$

The equations (1) and (3), which take similar forms conicide entirely with each other if the circuit constants are determined as satisfying the equations (4) below. As a result, the reference time $t$ is increased with the decrease in the source voltage $V_c$ and vice versa, thereby maintaining the primary cut off current $I_c$ constant.

$$\left.\begin{aligned} V_Z &= R \cdot I_c \\ \frac{L}{R} &= C_5 \cdot R_{52} \end{aligned}\right\} \quad (4)$$

Actually, however, the equation (4) need not be strictly satisfied. In order to realize the above-described control system, the reference time signal generated in the reference time signal generator means as mentioned above is applied to the input of the voltage comparator 20 as in the conventional system and compared with the flow time of the primary current in the ignition coils which is detected and controlled by the pick-up coil 10. The output of the comparator 20 is applied to the Darlington pair 32 constituting a power transistor through the comparator 30 and through the transistor 31, thereby regulating the flow time of the primary current in the ignition coils 4.

In this way, it is possible to produce a constant primary cut off current, so that a substantially constant voltage and energy may be generated on the secondary side of the ignition coils 4 against any variations in source voltage.

Figure 6:
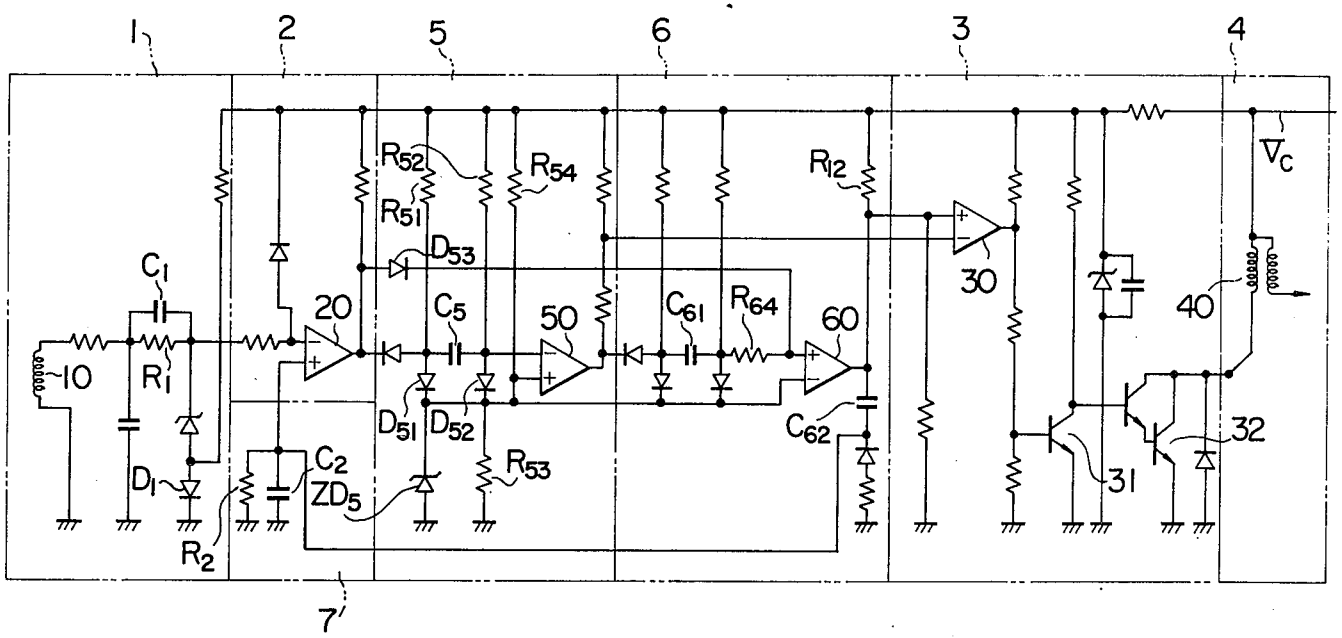
FIG. 6 is a circuit diagram showing still another embodiment of the invention.

Another embodiment of the invention is shown in FIG. 6. The output of the comparator 20 of the energization time signal generator means 2 is applied through the diode $D_{53}$ to the input of the comparator 60 of the time difference detector means 6, while the output of the comparator 50 of the reference time generator means 5 is applied to the input of the comparator 60 of the time difference detector means 6 through the capacitor $C_{61}$ and resistor $R_{64}$.

The output of the time difference detector means 6 is applied through the capacitor $C_{62}$ to the time difference voltage converter means where it is converted into a signal corresponding to the magnitude of the time difference.

The comparator 30 of the amplifier means 31 takes a logical sum of the output of the comparator 50 and the output of the comparator 60. This configuration is equivalent to direct application of the output of the comparator 20 to the input of the comparator 30 except that in the control system with the output of the comparator 20 directly applied to the comparator 30 the output of the comparator 20 is constantly produced even when the engine stops with the primary current flowing, often resulting in the waste of power in the primary coil. Unlike such a conventional system, the comparators 50 and 60 enter a stable state upon the stoppage of the engine and no output is produced therefrom, with the result that no current flows in the primary winding irrespective of whether or not an output is produced from the comparator 20.

In the above embodiments as shown in FIG. 2, 4 and 6, the ignition signal from the pick up coil 10 is applied to the input terminal of the comparator 20 comprising an operation amplifier. The comparator 20 has large input impedance and a required input current for operation is very small. Namely, the comparator 20 can be regarded as an element which responses to the voltage of the pick up coil 10. If a delay of the current flowing in the pick up coil 10 to the voltage thereof becomes large because of the large reactance of the pick up coil, such delay is eliminated by using the operation amplifier as a comparator.

I claim:

1. In an ignition apparatus for an internal combustion engine comprising a direct current potential source, an ignition coil having a primary winding, an energizing circuit including a switching transistor for controlling an energizing current through said primary winding, an ignition signal generator for producing an alternating current ignition signal in timed relationship with the rotation of an engine, and an energization time duration signal generator means for generating an energization time during signal in means for generating an energization time during signal in synchronism with said alternating current ignition signal, and wherein said energizing circuit for operating said switching transistor feeds said energizing current to said primary winding at the beginning of said energization time duration signal and breaks said energizing current at the end of said energization time duration signal;

the improvement comprising means for producing a reference time duration signal in synchronism with said energization time duration signal, a time duration difference detector means for producing a duration difference signal proportional to the difference in length of time duration between said reference time duration signal and said energization time duration signal, a feed back means to negatively feed back said time duration difference signal to said energization time duration signal generator means thereby minimizing the difference in length of time duration between said energization signal and said reference time signal.

2. An ignition apparatus for an internal combustion engine according to claim 1, wherein said feed back means comprises a time difference voltage converter means to produce output voltage proportional to the difference in length of time duration between said energization signal and said reference time signal, and said energization time duration signal generator means comprising a comparing means to receive said alternating current ignition signal and the output of said time difference voltage converter means.

3. An ignition apparatus for an internal combustion engine according to claim 2, wherein said means for producing a reference time duration signal changes the duration of reference time duration signal proportion to the magnitude of said direct current potential source voltage.

4. An ignition apparatus for an internal combustion engine according to claim 1, wherein said reference time duration signal is of a predetermined constant pulse duration.

* * * * *